US011721945B2

(12) United States Patent
Phelan

(10) Patent No.: US 11,721,945 B2
(45) Date of Patent: Aug. 8, 2023

(54) CRIMPING TOOL

(71) Applicant: Elpress AB, Kramfors (SE)

(72) Inventor: Max Phelan, Kramfors (SE)

(73) Assignee: ELPRESS AB, Kramfors (SE)

( * ) Notice: Subject to any disclaimer, the term of this patent is extended or adjusted under 35 U.S.C. 154(b) by 0 days.

(21) Appl. No.: 17/565,947

(22) Filed: Dec. 30, 2021

(65) Prior Publication Data

US 2022/0224067 A1 Jul. 14, 2022

(30) Foreign Application Priority Data

Jan. 13, 2021 (SE) ..... 2150021-0

(51) Int. Cl.
*H01R 43/042* (2006.01)

(52) U.S. Cl.
CPC ..... *H01R 43/0428* (2013.01)

(58) Field of Classification Search
CPC ..... H01R 43/0428; H01R 43/0427; H01R 43/048; H01R 43/042; B25B 27/14; Y10T 29/532; Y10T 29/5235
See application file for complete search history.

(56) References Cited

U.S. PATENT DOCUMENTS 3,507,270 A * 4/1970 Ferrier ..... A61B 5/02233 81/3.43
4,723,434 A 2/1988 Bush
5,195,042 A * 3/1993 Ferraro ..... H01R 43/0427 29/863
10,784,641 B2 * 9/2020 Couch ..... H01R 43/0428
2003/0230132 A1 * 12/2003 Bowles ..... B25B 27/10 72/416
2016/0099533 A1 4/2016 Kehoe
2019/0232481 A1 8/2019 Skinner et al.

FOREIGN PATENT DOCUMENTS

CN 209217240 U 8/2019
EP 3219443 A1 9/2017

OTHER PUBLICATIONS

European Search Report from corresponding European application No. 22151213.0, dated Jun. 23, 2022, 7 pages.
Swedish Search Report from corresponding Swedish Application 2150021-0, dated Sep. 13, 2021, 5 pages.

* cited by examiner

*Primary Examiner* — Donghai D Nguyen
(74) *Attorney, Agent, or Firm* — Cooper Legal Group, LLC; Ronald M. Kachmarik

(57) ABSTRACT

A crimping tool and associated method to create a mechanical and electrical connection between two cable elements. A tool body including a first and second attachment points. A first guidance element arranged at a first distance from the first and second attachment points. A second guidance element arranged at a second distance from the first guidance element. The first and second attachment points are arranged on a first side of the first and second guidance elements. A flexible cable with first and second end parts removably attached to the first and second attachment points, respectively. The cable engages the first and second guidance elements. The cable extends between the first and attachment points such that a loop is formed on a second side of the first and second guidance elements. A powering unit configured to increase the first distance so that a diameter of the loop decreases.

16 Claims, 6 Drawing Sheets

CRIMPING TOOL

TECHNICAL FIELD

The present invention relates to the field of power tools, more particularly, to crimping power tools for securing an end fitting or coupling to a conductor or wire, and a method for creating a mechanical and electrical connection between two cable elements using said crimping tool.

BACKGROUND

Within many different technical fields such as power stations, wind mills or facilities where larger quantities of electrical power are consumed or transferred there is a need for reliable connections between electrical conductor, for example cables or wires, and thereto related equipment. These connections are made by end couplings, crimping connectors or end fittings press fitted, i.e. crimped, to the end of the cable or wire by an electric or hydraulic pressing or crimping tool.

When using the crimping tools available today the end of the wire or cable is fitted within a recess in the end fitting, crimping connector or coupling before the end fitting or coupling is arranged within the clamping pincer of the tool. As soon as the end fitting or coupling is in the correct position one, or more, moving part of the pincer are moved towards the end fitting or end coupling and a predetermined pressure is applied to deform the end fitting or coupling to permanently clamp the end fitting or coupling to the wire or cable.

Today hydraulic crimpers of different designs are used for crimping cables, hydraulic pumps are used for pressurizing a hydraulic fluid and transfer it to a cylinder in the tool which causes an extensible piston to be displaced. This causes the piston to exert a force on the head of the power tool, which often has a pincer with opposed jaws, with crimping features. The jaws of today's crimpers are of a fixed and predetermined size and therefore different power tools have to be used for different cable dimensions, which may be problematic and inefficient.

There is a need in the field to provide new kinds of hydraulic crimping power tools for allowing crimping in a more efficient and easily managed way.

SUMMARY

The inventors have reached the insight that there is a need for a crimping tool for electrical connectors that can be used with any size of the electrical connector and/or cable to be crimped. The inventors have further reached the insight that having jaws as most of today's crimpers does not allow for an easy exchange of parts if the jaws are damaged in any way.

The present disclosure seeks to provide at least some embodiments of crimping tools which overcome at least some of the above-mentioned drawbacks. More specifically, the present disclosure aims at providing at least some embodiments offering a crimping device that can be used for any type of electrical cable and crimping connector. Further, the present disclosure aims at providing at least some embodiments with parts that can be easily exchanged in case of damage.

In a first aspect there is provided a crimping tool configured to create a mechanical and electrical connection between two cable elements. The crimping tool comprises a tool body comprising a first attachment point and a second attachment point. The crimping tool further comprises a first guidance element arranged at a first distance from the first attachment point and the second attachment point, and a second guidance element arranged at a second distance from said first guidance element. The first attachment point and the second attachment point are arranged on a first side of the first guidance element and the second guidance element. The crimping tool further comprises a flexible cable comprising a first end part removably attached to the first attachment point and a second end part removable attached to the second attachment point. The flexible cable engages the first guidance element and the second guidance element, and the flexible cable extends from the first attachment point to the second attachment point such that a loop is formed on a second side of the first guidance element and the second guidance element opposite the first side. The crimping tool further comprises a powering unit configured to increase the first distance so that a diameter of the loop decreases.

In a second aspect is provided a method for creating a mechanical and electrical connection between two cable elements using a crimping tool according to the first aspect of the invention. The method comprises forming a loop with a flexible cable by folding the flexible cable and attaching a first end part to a first attachment point of the crimping tool and a second end part to a second attachment part of the crimping tool. The method further comprises inserting a first cable element into the loop, inserting a second cable element into the loop and activating a powering unit of the crimping tool configured decrease a diameter of the loop to allow said flexible cable to apply a pressure on the first cable element and the second cable element. The method further comprises deactivating the powering unit when the first cable element and the second cable element have been deformed so that a mechanical and electrical connection has been established.

Thus, there is provided a device or a method, with a first function of establishing a mechanical and electrical connection between two cable elements. The device brings many advantages, a first advantage being that many sizes of cable elements can be connected using the same tool and method. This is advantageous in that a single tool and method can be used for different situations without the need to change tool or tool parts. A further advantage with the present invention is that if the flexible cable where to break it can be changed easily, this allows for an easy fix and there is no need to acquire a new tool.

With the term "cable element" is meant an electrical conductor or wire. Further, the term includes so called crimping connectors or end fittings. Commonly one end of an electrical conductor or wire is fitted into a recess of a crimping connector or end fitting, then pressure is applied to the crimping connector to crimp the cable elements together so that a mechanical and electrical connection is established. So, when the term "two cable elements" is used, it may refer to one cable or wire that is fitted into one end fitting or crimping connector. However, it may refer to other combinations of cable elements as well.

According to an embodiment, the crimping tool further comprises a mounting structure, wherein the first guidance element and the second guidance element are attached to the mounting structure. The present embodiment is advantageous in that the mounting structure will help in ensuring that the flexible cable stays in its correct position. Further, the flexible cable will exert a force on the guidance elements, the mounting structure will help keep the guidance elements in their correct position by taking part of the force exerted by the flexible cable. The mounting structure can for example comprise two plates on opposite sides of the flexible cable being connected by the guidance elements placed between them. It is understood that other mounting structures are possible.

According to another embodiment, at least one of the first guidance element and the second guidance element is rotatably attached to the mounting structure. The present embodiment is advantageous in that if one of the guidance elements is rotatably attached to the mounting plates it can be used as a rolling guider for the flexible cable. The first distance can for example be increased by pulling on the attachment points or by pushing on the guidance elements, the flexible cable will therefore move in relation to the guidance elements, and if at least one of these is rotatably attached this movement will be smoother and without as much friction, which is preferable. It is understood that both guidance elements could be rotatably attached to the mounting structure.

According to another embodiment the at least one of the first guidance element and the second guidance element rotatably attached to the mounting structure comprises a circular disc with a U-formed indentation along a circumference of the circular disc. The present embodiment is advantageous in that the U-formed indentation along the circumference of the circular disc can engage and guide the flexible cable during movement. The guidance element will then rotate allowing for a smooth movement of the flexible cable while at the same time ensuring that the cable is kept in a wanted position allowing for the diameter of the loop to decrease steadily. The U-formed indentation may for example be configured to match a diameter or thickness of the flexible cable to ensure for a good fit and ensure the flexible cable is kept in the wanted position. It is understood that any other shape of the indentation could be used to center or align the flexible cable, for example a V-shaped or C-shaped indentation.

According to another embodiment, the at least one of the first guidance element and the second guidance element rotatably attached to the mounting structure comprises a bearing shaft and a roller bearing. The present embodiment is advantageous in that the guidance element/s is rotatably attached using a common and well used method. The roller bearing may for example be a standard industry roller bearing constructed for enduring a certain force or pressure. A bearing shaft may connect the mounting structure and extend through a bearing of the guidance element for ensuring a smooth rolling of the guidance element/s and an easy moving of the flexible cable and operation of the crimping tool.

According to another embodiment, the powering unit comprises a hydraulic drive arranged to increase said first distance so that said diameter of said loop decreases. The present embodiment is advantageous in that hydraulic drives can create a strong force which may be needed when crimping certain cable elements or crimping connectors. A hydraulic drive ensures easier use for a user and less manual work is needed. It is understood that other powering units can be used, for example an electrically actuated system could be used. One such electrically actuated system could be configured to, with an electrical motor, rotate a screw that mechanically moves parts of the crimping tool to increase the first distance.

According to another embodiment, the powering unit is configured to increase the first distance by moving the first attachment point and or the second attachment point away from the first guidance element and the second guidance element. This can be seen as one or both end parts of the flexible cable being pulled away from the guidance elements, and thusly decreasing the diameter of the loop. The present embodiment is advantageous in that the crimp may be more symmetrical if both ends are pulled at the same time. The diameter of the at least partially circular fold will decrease equally from both sides and the flexible cable will press on the object/s to be crimped almost equally from all sides. If both ends are pulled the risk for the object/s to be crimped to move out of position also diminishes, which is preferable.

According to another embodiment, the powering unit is configured to increase the first distance by moving the first guidance element and the second guidance element away from the first attachment point and the second attachment point. The present embodiment is advantageous in that the crimp may be more symmetrical. If the guidance elements are pushed or moved away from the attachment points they will move toward the loop of the flexible cable, which will lead to the diameter of the loop decreasing causing the flexible cable to apply a pressure upon the cable elements to be crimped. The present embodiment may be advantageous in that moving the guidance elements may be easier than moving the attachment points, for example by fastening the guidance elements to the mounting structure and fastening one or more extendable metal rods to the mounting structure and extending the rods using hydraulics. Other ways of moving the guidance elements are possible and available to a person skilled in the art.

According to another embodiment, both the first guidance element and the second guidance element are rotatable and wherein both the first guidance element and the second guidance element comprises a circular disc with a U-formed indentation along a circumference of said circular disc. The present embodiment is advantageous in that both guidance elements will engage the flexible cable and allow it to move with respect to the guidance elements in an easy manner. For example, both guidance elements may comprise a bearing shaft and a bearing for allow easy rotation when the flexible cable moves as it engages the guidance elements. It is understood that the U-formed indentation may have any other convenient shape for centering the cable along the circumference of the guidance element.

According to another embodiment, the second distance is larger than one radius of the flexible cable and smaller than five radii of the flexible cable. The present embodiment is advantageous in that if the second distance is kept relatively small the flexible cable will exert a pressure on the object/s to be crimped from all sides since the loop will almost form a complete circle. The smaller the second distance is made the more circular the loop will be, and the compressing force will be more symmetrical. It is understood that the second distance may be varied depending on the material of the flexible cable. If the flexible cable comprises a material that can be compressed along its cross-section the second distance may be between one and five radii of the flexible cable. If the flexible cable comprises a material that cannot be compressed, a flexible cable with constant radius, the second distance may be between four and five radii of the flexible cable.

According to another embodiment, the flexible cable is braided by fibers of a high strength material, for example Dyneema fiber. By the word "braided" is meant intertwined or woven or interlaced fibers/strings of a material. The present embodiment is advantageous in that a braided cable will have a higher endurance than a non-braided cable. The high strength material may be any suitable material such as a metal or an alloy of metals. One example is Dyneema which is a high strength material which has a lot of preferable features such as low friction, low creep, high modulus, high strength to weight ratio, low elongation at break with high energy need to be break and more. Dyneema or other synthetic fiber materials are further advantageous in that they are often lighter than metal, and thus they are advantageous to be used as the flexible cable. These may be so called aramid materials, including for example Dyneema and Kevlar. Other materials, such as polyamides or polyesters are also possible. Further, a range of other materials are possible to be braided or intertwined to create the flexible cable. It is further understood that the cable does not need to be braided in certain embodiments. The flexible cable needs to be sufficiently strong and durable to hold when crimping. For this a minimum tensile strength of the flexible cable may be around 97 MPa. The preferred tensile strength may be bigger, for example such as the tensile strength of Dyneema at 3600 MPa. It is understood that when different cable elements are crimped different tensile strengths of the flexible cable may be needed.

According to another embodiment the crimping tool further comprises a control unit configured to measure work performed by the powering unit and/or continually measure the first distance to ensure that the diameter of the loop has decreased sufficiently for establishing a mechanical and electrical connection between the first cable element and the second cable element. The present embodiment is advantageous in that a user does not need to keep track on how much the cable elements have been compressed, the tool can monitor this which will ensure a more secure and better crimping.

According to an embodiment of the second aspect of the invention, the first cable element is a crimping connector and the second cable element is inserted into the crimping connector prior to activating the powering unit. The present embodiment is advantageous in that a crimping connector is configured to be deformed around another cable element. Some crimping connectors comprise a metal cylinder part where a second cable element can be inserted, and the metal cylinder can then be deformed until a stable mechanical and electrical connection is established.

According to another embodiment of the second aspect of the invention, further comprising removing the crimping tool from the first cable element and the second cable element after deactivating the powering unit, wherein removing the crimping tool is done by detaching at least one end part of the flexible cable from the crimping tool. The present embodiment is advantageous in that detaching at least one end of the flexible cable can make removing the crimping tool from the cable elements easier after the cable elements have been joint.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features. In particular, it will be appreciated that the embodiments described above apply to the first and the second aspects of the present disclosure.

BRIEF DESCRIPTION OF THE DRAWINGS

Exemplifying embodiments will now be described in more detail, with reference to the following appended drawing.

DETAILED DESCRIPTION

Figure 1:
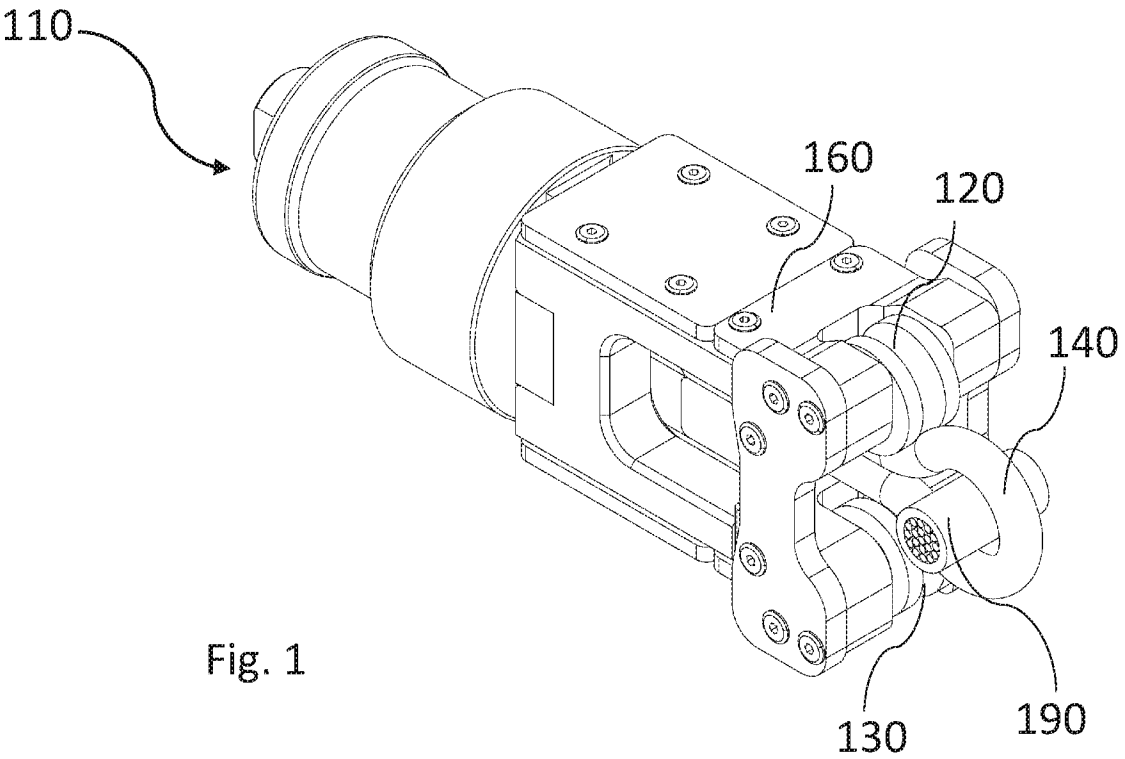
FIG. 1 schematically illustrates a tool body of an exemplary crimping tool in accordance with an embodiment.

As illustrated in the figures, the sizes of the elements and regions may be exaggerated for illustrative purposes and, thus, are provided to illustrate the general structures of the embodiments. Like reference numerals refer to like elements throughout.

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

With reference to FIG. 1 a tool body 110 of an exemplary crimping tool in accordance with an embodiment is disclosed.

A crimping tool according to the invention may be used to crimp two cable elements 190 to each other to create both a mechanical and electrical connection.

Figure 2:
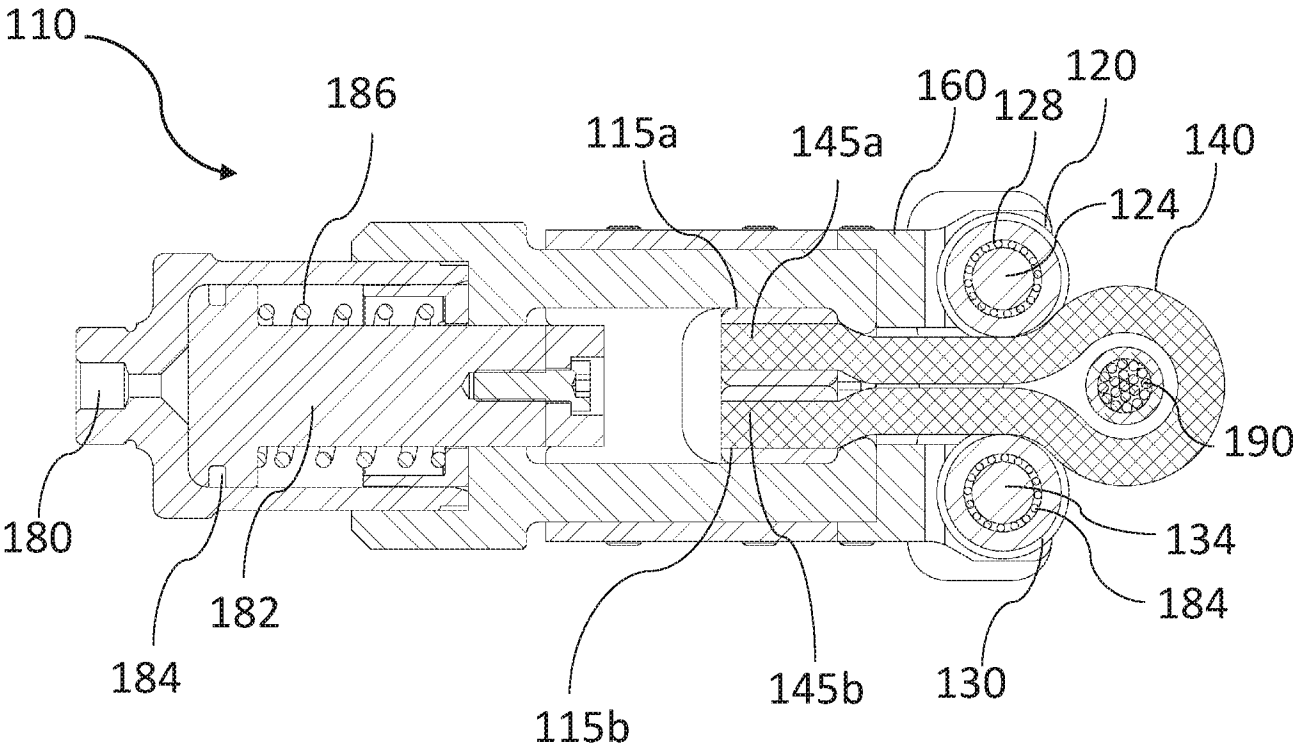
FIG. 2 schematically illustrates a cross section of a tool body of an exemplary crimping tool in accordance with an embodiment.

FIG. 1 illustrates a tool body 110 comprising a first attachment point and a second attachment point, the attachment points are not visible in FIG. 1, reference to FIG. 2 is made. The tool body 110 further comprises a first guidance element 120 arranged at a first distance from the first attachment point and the second attachment point. The tool body 110 also comprises a second guidance element 130 arranged at a second distance from the first guidance element. The first attachment point and the second attachment point are arranged on a first side of the first guidance element 120 and the second guidance element 130.

FIG. 1 further illustrates a flexible cable 140 being a part of the complete crimping tool. The flexible cable 140 comprises a first end part removably attached to the first attachment point and a second end part removably attached to the second guidance element. The flexible cable 140 engages the first guidance element 120 and the second guidance element 130. The flexible cable 140 extends from the first attachment point to the second attachment point such that a loop is formed on a second side of the first guidance element and the second guidance element opposite the first side. It is understood that the first and second attachment points also could be constructed to be one and the same attachment point for both the first and second end part of the flexible cable 140.

The crimping tool may further comprise a powering unit configured to increase the first distance so that a diameter of the loop decreases. In the exemplary embodiment disclosed in FIG. 1 a powering unit may connect to the end of the tool body opposite the loop of the flexible cable 140. The powering unit may for example be a hydraulic system comprising a hydraulic fluid that is pressurized and configured to cause the increase of the first distance. Further details are found with relation to the remaining Figures.

The embodiment of FIG. 1 also discloses a mounting structure 160. The first guidance element 120 and the second guidance element 130 are attached to the mounting structure 160. The mounting structure 160 can help ensuring that the guidance elements 120, 130 are kept in a correct position even when pressure from the flexible cable 140 is added. Further, at least one of the first guidance element 120 and the second guidance element 130 may be rotatably attached to the mounting structure 160. This can ensure an easy motion when the flexible cable 140 engaging the guidance elements 120, 130 moves in relation to the guidance elements 120, 130. The flexible cable 140 will move in relation to the guidance elements 120, 130 when the powering unit increases the first distance. In the embodiment of FIG. 1 the guidance elements 120, 130 are both rotatably attached to the mounting structure 160 using bearing shafts and roller bearings. Of course, other ways of rotatably fastening the guidance elements are available to a person skilled in the art.

The first guidance element 120 and the second guidance element 130 are in the embodiment of FIG. 1 both circular discs with a U-formed indentation along a circumference of the disc. The U-formed indentation is used to center and align the flexible cable 140 to ensure that it is kept in a centered position during use of the crimping tool. It is of course understood that other shapes and forms of said guidance elements 120, 130 are available. Also, the indentation may comprise a different shape, such a V-shape, C-shape or any other convenient shape for centering the flexible cable 140.

The flexible cable 140 can be made from any suitable material. For example, the flexible cable 140 can be made from a Dyneema rope. Dyneema is also known as High Modules Polyethylene (HMPE) and is one example of a preferred material for the flexible cable 140 due to its properties of high strength and low friction and weight. Dyneema has a tensile strength of 3600 MPa which may be preferred in certain embodiments. However, other material choices are available such as metal cables or ropes or synthetic fiber ropes. Such materials are for example most aramid materials, such as Kevlar, or polyamides and polyesters. The flexible cable 140 may be braided by fibers of such a high strength material. In some embodiments a tensile strength of 97 MPa may be sufficient for the flexible cable 140 to be able to crimp the cable elements 190 without being damaged. It is understood that for different thickness and material of the cable elements 190 different materials or tensile strengths of the flexible cable 140 may be preferred.

The second distance between the first guidance element 120 and the second guidance element 130 can vary depending on the material of the flexible cable 140. If the flexible cable 140 comprises a material that can be compressed along its cross-section the second distance may be between one and five radii of the flexible cable 140. If the flexible cable 140 comprises a material that cannot be compressed, a flexible cable 140 with constant radius, the second distance may be between four and five radii of the flexible cable.

The different components of the crimping tool may be controlled by a control unit arranged within the tool body 110. The control unit can monitor and control the operation of the crimping tool. The crimping tool may also comprise a user interface for delivering information from the tool to the user and make it possible for the user to adjust or select different operational parameters of the crimping tool such as for example the intended size and type of the end fittings or couplings. The control unit may be configured to measure work performed by the powering unit. It may also be configured to continually measure the first distance to ensure that the diameter of the loop decreases sufficiently for establishing a mechanical and electrical connection between the first cable element and the second cable element before deactivating the powering unit.

The crimping tool according to the present invention may further comprise a position sensor arranged within the tool body 110 to detect how much the first distance is increased or decreases. This can make sure that the applied pressure from the flexible cable 140 onto cable element to be crimped can be controlled. The position sensor may be arranged on or within the tool body 110 and comprise one detecting part on one or both of the guidance elements 120, 130 and a corresponding part arranged on one or both attachment points such that the movement between the attachment points and guidance elements 120, 130 can be detectable by the sensor.

Furthermore, the crimping tool may comprise a pressure sensor arranged to detect the pressure applied on the cable elements to be crimped. Different types of pressure sensors could be used. One favorable embodiment involves a pressure sensor arranged to detect a pressure within a pressurized hydraulic fluid of the powering unit to determine the pressure applied by the flexible cable 140 on the cable elements during the crimping process.

In the crimping tool according to the invention, the control unit may be arranged to control the operation of the tool during the crimping process and continuously collect and store the information detected by the position sensor regarding the position attachment points and guidance elements 120, 130 in relation to each other and the information regarding the applied pressure on the cable elements.

The crimping tool may be configured to be held by a user. It may have any convenient shape or size that allows for it to be used by a single user. For example, it may have a standard power tool shape and size, as for example a hand-held drill.

With reference to FIG. 2 a cross section of the tool body 110 of FIG. 1 of an exemplary crimping tool in accordance with an embodiment is disclosed.

Details regarding some features of the tool body 110 can be found with reference to FIG. 1.

In FIG. 2 the first end part 145*a* attached to the first attachment point 115*a* can be seen. The first attachment point 115*a* comprises a hole or indentation where the first end part 145*a* of the flexible cable 140 can be fitted. Similarly, the second end part 145*b* is fitted within the second attachment point 115*b*. Other types of attachments or constructions are possible, for example the end parts 145*a*, 145*b* could comprise loops that are hooked onto some sort of arrangements of the attachment points 115*a*, 115*b*. Further it is understood that a single attachment point could be used for both end parts 145*a*, 145*b*.

The tool body 110 can be connected to a powering unit. The exemplary tool body 110 of FIG. 2 is configured to be attached to a hydraulically driven powering unit. Hydraulic fluid can be pressed through inlet 180 to move piston 182 towards the loop of the flexible cable 140. When the fluid is pressed through the inlet 180 the piston 182 will move towards the loop and due to the mechanical connections to the guidance elements 120, 130 will also be moved in the same direction which will cause the first distance to be increased. When the guidance elements 120, 130 are moved with relation to the flexible cable 140 the diameter of the loop will decrease. The guidance elements 120, 130 are rotatably connected to the mounting structure 160 via bearing shafts 124, 134 and roller bearings 128, 138 and will roll against the flexible cable 140 as the first distance increases. The flexible cable 140 will eventually come into contact with the cable elements 190 and exert a pressure upon them. The hydraulic driven powering unit can ensure that the pressure from the flexible cable 140 is big enough to create a mechanical and electrical connection between two cable elements 190, for example a cable and a crimp connector, place within the loop. To avoid leaking of hydraulic fluid a rubber ring, or gasket, 184 is placed around the piston 182. Further, when no pressure is pushing hydraulic fluid into the inlet the spring 186 will push the piston 182 back to the position disclosed in FIG. 2.

It is understood that other powering units and constructions of the tool body 110 are possible. For example, an electrical motor can be configured to rotate a screw which moves piston 182 towards the loop of the flexible cable 140. The powering unit can be controlled using a control unit as described in relation to FIG. 1.

In the embodiment in FIG. 2 the first distance between the attachment points 115*a*, 115*b* and the guidance elements 120, 130 is increased by moving the guidance elements 120, 130 away from the attachment points 115*a*, 115*b*. It is understood that the opposite is also possible, that the powering unit could be configured to increase the first distance by moving the attachment points 115*a*, 115*b* away from the guidance elements 120, 130. This motion could be seen as pulling or tugging on the end parts 145*a*, 145*b* of the flexible cable 140 and would also end with a smaller diameter of the loop. In certain embodiments only one of the end parts 145*a*, 145*b* is moved away from the guidance elements 120, 130. However, if both end parts 145*a*, 145*b* are moved a more symmetrical compressing force on the cable elements is obtained.

Figure 3:
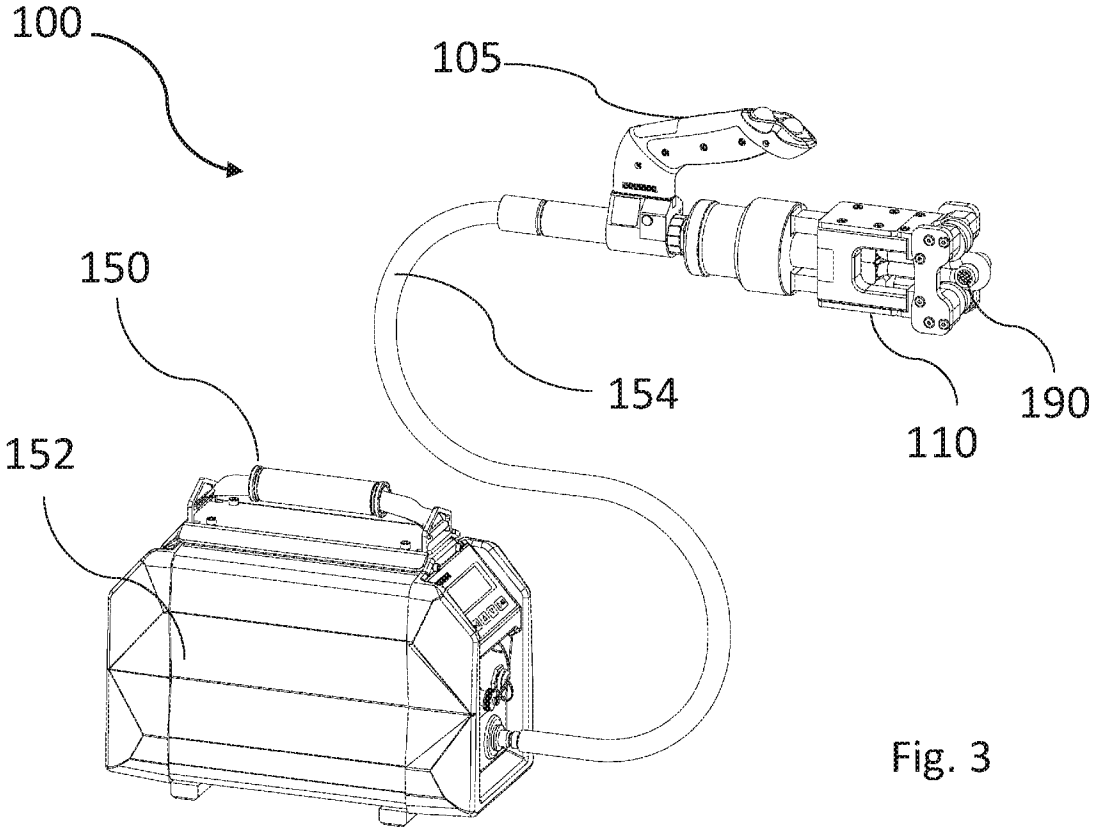
FIG. 3 schematically illustrates an exemplary crimping tool in accordance with an embodiment.

With reference to FIG. 3 an exemplary crimping tool 100 in accordance with an embodiment is illustrated.

The crimping tool 100 comprises a tool body 110 as the one illustrated in FIGS. 1 and 2. The crimping tool 100 of FIG. 3 further comprises a hydraulically driven powering unit 150. The powering unit 150 may be a conventional hydraulic system used for these types of product. The powering unit 150 comprises a storage tank 152 for storing a hydraulic fluid. The storage tank 152 is in fluid connection to a pump that is arranged to generate a flow of pressurized hydraulic fluid from the storage tank via tube 154 to an inlet of the tool body 110. The pressurized hydraulic fluid can move a piston of the tool body 110 which in turn increases a distance between guidance elements and attachment points of the tool body 110. This causes a loop of a flexible cable to tighten and apply pressure upon cable elements 190 placed in the loop. Further details regarding the mechanical movements are explained throughout the application. The hydraulic driven powering unit 150 may also be exchanged with an electrically driven system or other conventional powering systems that the create a mechanical movement with sufficient strength to crimp wires.

The crimping tool 100 further comprises a handle 105. The handle can be of any convenient size or shape for a user and may comprise start and stop buttons for activating and stopping the powering unit 150.

With reference to FIG. 4 the movement of a flexible cable of an exemplary crimping tool in accordance with an embodiment is illustrated.

Figure 4C:
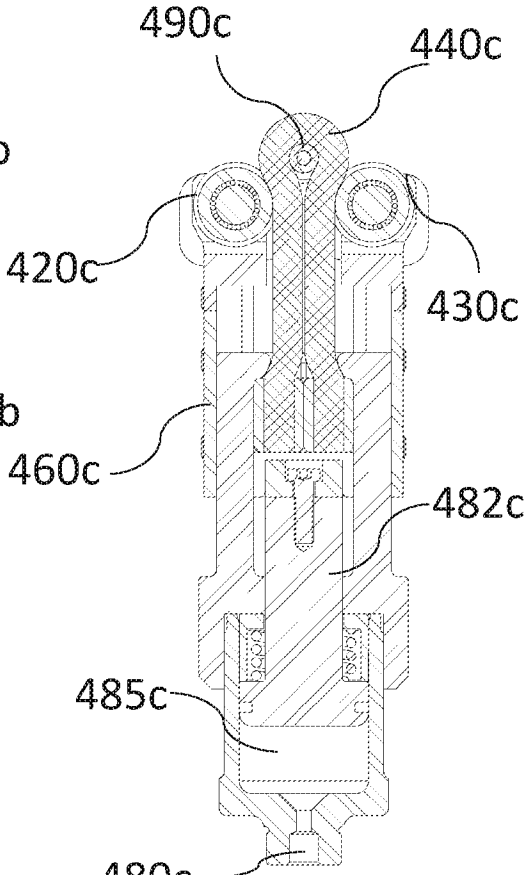
FIGS. 4B and 4C schematically illustrates a tool body of an exemplary crimping tool in two different states.
Figure 4B:
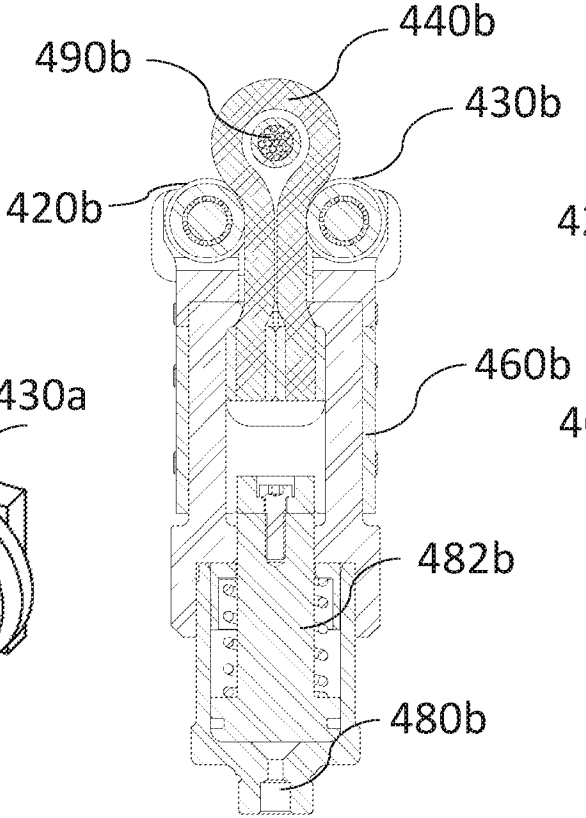
Figure 4A:
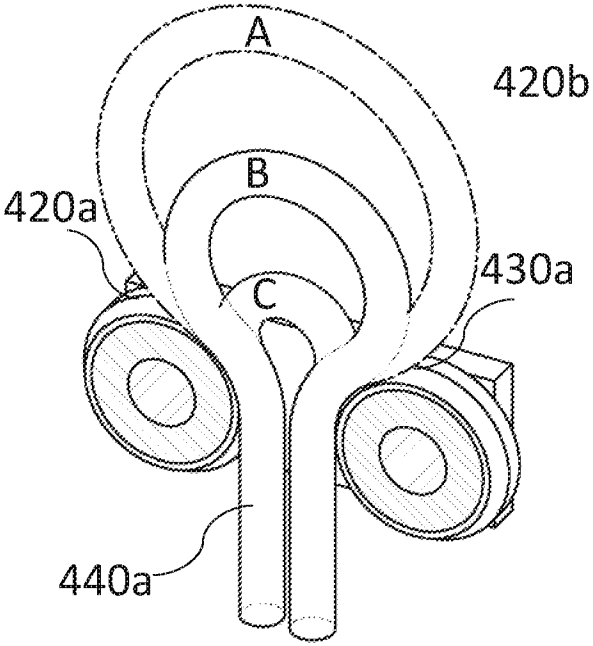
FIG. 4A schematically illustrates the movement of a flexible cable of an exemplary crimping tool in accordance with an embodiment.

In FIG. 4A a flexible cable 440*a* a crimping tool according to the invention is shown in three states A, B and C. Further, a first guidance element 42*a*0 and a second guidance element 430*a* of a crimping tool is disclosed. The Figure intends to illustrate of the flexible cable 440*a* behaves during use of the crimping tool. The distance between the guidance elements 420*a*, 430*a* in FIG. 4A is approximately equal to 4 radii of the flexible cable 440*a*. This ensures that when the loop is tightened the flexible cable 440*a* may exert a pressure upon an object inside the loop from almost all sides. The distance between the guidance elements 420*a*, 430*a* can vary depending on the wanted crimping effect and material of the flexible cable 440*a*.

In a first state A the flexible cable 440*a* has been mounted engaging the guidance elements 420*a*, 430*a* and attached to a first and second attachment point. The flexible cable 440*a* has a loop on one side of the guidance elements 420*a*, 430*a* with a first diameter. During state A two cable elements, for example an electrical conductor or wire and a crimping connector could be fitted in the loop of the flexible cable 440*a*.

In a second state B the diameter of the loop of the flexible cable 440*a* has decreased. This has occurred due to the movement of the guidance elements 420*a*, 430*a* with respect to the attachment points of the flexible cable 440*a*. State B may show when the flexible cable 440*a* first comes into contact with cable elements placed within the loop and starts to apply a pressure upon them.

In a third state C the diameter of the loop of the flexible cable 440*a* has decreased again. The distance between the guidance elements 420*a*, 430*a* and the attachment points has increased even more which causes the loop to tighten. In FIG. 4A no cable elements are present, so the loop has almost disappeared completely. If cable elements would have been present, they would have been compressed by the continuing decreasing of the diameter of the loop ultimately causing a mechanical and electrical connection between the cable elements.

With reference to FIGS. 4B and 4C a tool body of an exemplary crimping tool in two different states is illustrated.

In FIG. 4B cable elements 490*b* have been placed in a loop of flexible cable 440*b*. The cable elements 490*b* may for example be an electrical wire or conductor fitted into a crimping connector or end fitting. In FIG. 4B a powering unit has not yet been activated and piston 482*b* is in a first position since no hydraulic fluid has been pressed into the inlet 480*b*. The piston 482*b* is mechanically connected to a mounting structure 460*b* which is connected to guidance elements 420*b*, 430*b*. When the piston 482*b* is moved the mounting structure 460*b* and the guidance elements 420*b*, 430*b* will move together causing a diameter of the loop of the flexible cable to decrease and apply a pressure upon the cable elements 490*b*.

In FIG. 4C a hydraulic drive powering unit has been activated and hydraulic fluid has been pressed into the inlet 480*c*. This has caused piston 482*c* to move away from inlet 480*c* causing space 485*c* to fill with pressurized hydraulic fluid. Mounting structure 460*c* and guidance elements 420*c*, 430*c* have also moved since they are mechanically connected to the piston 482*c*. This has caused the loop of flexible cable 440*c* to tighten and the flexible cable 440*c* has exerted a compressive force or pressure on the cable elements 490*c* causing them to deform. This deformation can create a mechanical and electrical connection between the cable elements 490*c*.

Figure 5:
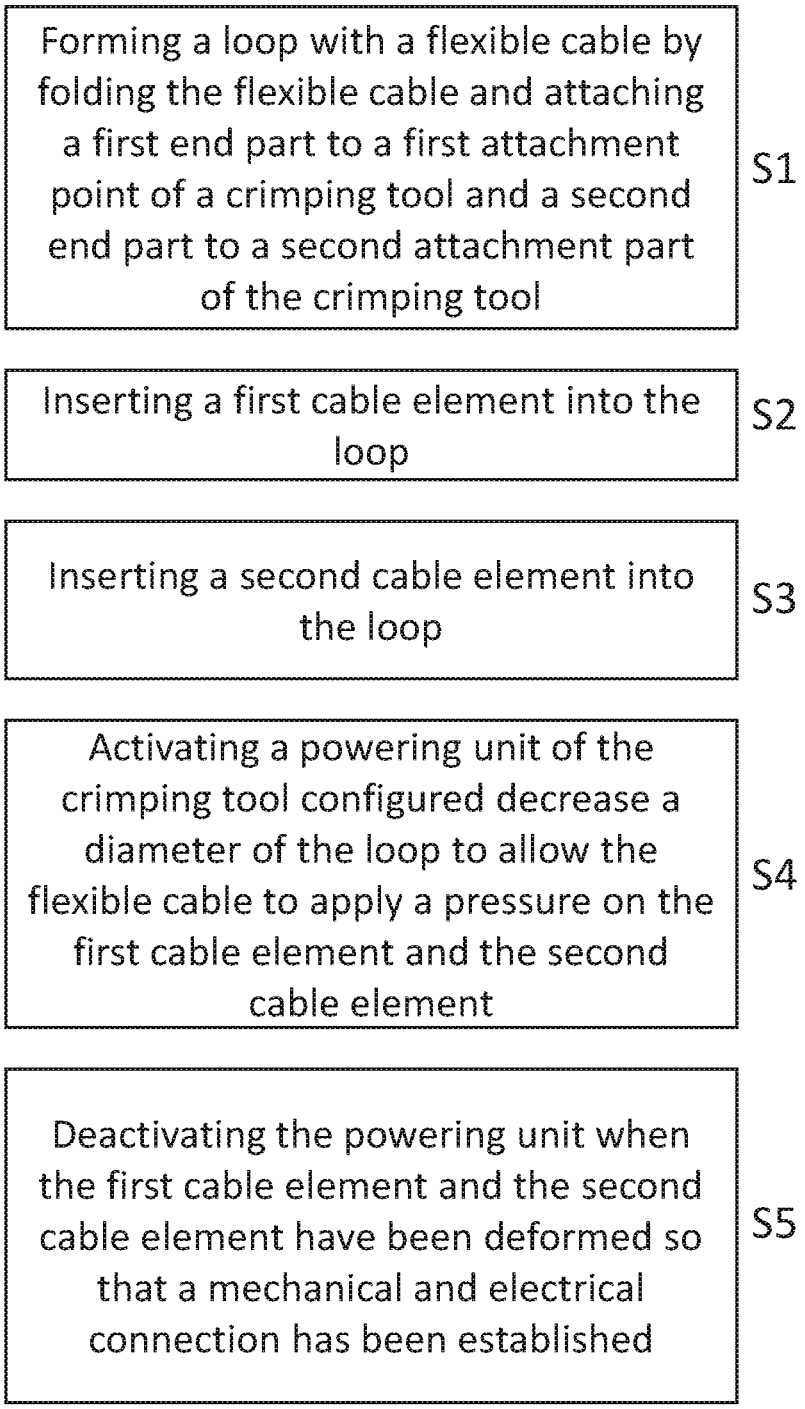
FIG. 5 illustrates an exemplary method for using a crimping tool in accordance with an embodiment.

With reference to FIG. 5 a method for creating a mechanical and electrical connection between two cable elements using a crimping tool according to the invention is disclosed.

In a first step S1 a loop is formed by a flexible cable by folding the flexible cable and attaching a first end part to a first attachment point of a crimping tool and a second end part to a second attachment part of the crimping tool. In a second step S2 a first cable element is inserted into the loop. In a third step S3 a second cable element is inserted into the loop. In a fourth step S4 a powering unit of the crimping tool is activated configured to decrease a diameter of the loop to allow the flexible cable to apply a pressure on the first cable element and the second cable element. In a fifth step S5 the powering unit is deactivated when the first cable element and the second cable element have been deformed so that a mechanical and electrical connected has been established.

The method may further comprise removing the crimping tool from the first cable element and the second cable element after deactivating the powering unit. This may be done by detaching at least one end part of the flexible cable from the crimping tool.

The method may further comprise the step of measuring the compressive force caused by the flexible cable to ensure that a proper crimping is done. This may for example be measure by a control unit of the crimping tool that may measure the work executed by the powering tool or the decrease of the diameter of the loop. Other ways of ensuring that the crimping is not stopped until a proper crimping has been obtained are available.

Advantages with using a crimping tool as in the method of FIG. 5 are for example that the diameter of the at least partially circular fold of the flexible cable can be made into different lengths allowing different sizes of cable elements to be fitted inside to be crimped. There is no need for different tools for different crimping connectors, one tool is sufficient.

Figure 6A:
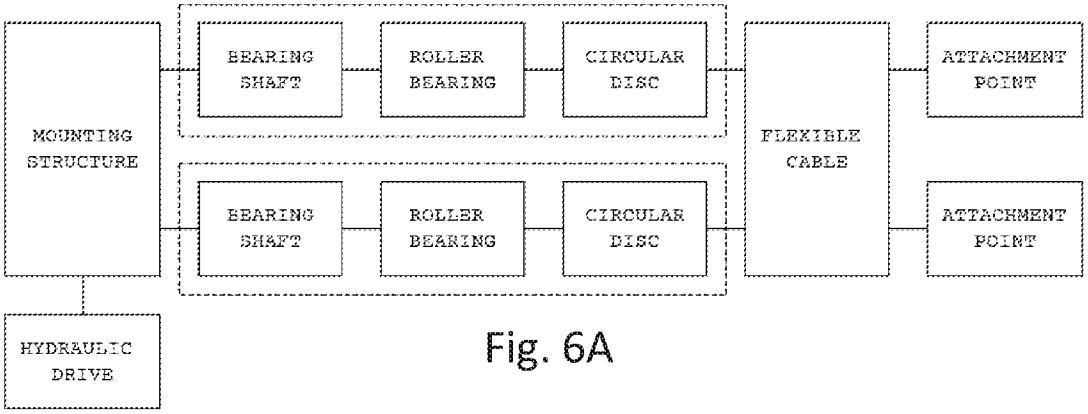
FIGS. 6A and 6B schematically illustrates component compositions for two different embodiments.
Figure 6B:
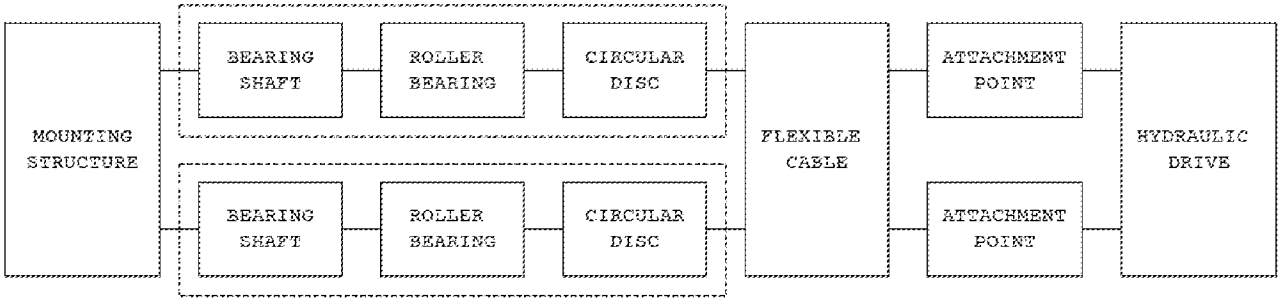

With reference to FIGS. 6A and 6B component compositions for two different embodiments is illustrated.

In FIG. 6A the hydraulic drive is configured to increases the distance between the guidance elements and the attachment points by moving the mounting structure connected to the guidance elements. In this embodiment the guidance elements comprise bearing shafts, roller bearings and a circular disc. The guidance elements are mechanically connected to a mounting structure which is moved by the hydraulic drive which causes them to move and roll against a flexible cable. The flexible cable is attached to two attachment points, which are held stationary, and forms a loop on one side of the guidance elements which tightens when the guidance elements are moved.

In FIG. 6B the hydraulic drive is instead connected to the attachment points of the crimping tool and configured to move these away from the guidance elements. The flexible cable will behave in the same way as in the embodiment of FIG. 6A, the loop will tighten when the hydraulic drive is activated. In this embodiment the guidance elements are also connected to a mounting structure, but the difference is that the mounting structure is static, and the position of the attachment points is adjustable.

Although features and elements are described above in particular combinations, each feature or element can be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. A crimping tool configured to create a mechanical and electrical connection between two cable elements, said crimping tool comprising:

a tool body comprising;

a first attachment point;

a second attachment point;

a first guidance element arranged at a first distance from said first attachment point; and a second guidance element arranged at a second distance from said first guidance element, wherein said first attachment point and said second attachment point are arranged on a first side of said first guidance element and said second guidance element, respectively;

a flexible cable comprising:

a first end part removably attached to said first attachment point;

a second end part removably attached to said second attachment point, wherein said flexible cable engages said first guidance element and said second guidance element, and wherein said flexible cable extends from said first attachment point to said second attachment point such that a loop is formed on a second side of said first guidance element and said second guidance element opposite said first side; and a powering unit configured to increase said first distance so that a diameter of said loop decreases.

2. The crimping tool according to claim 1 further comprises a mounting structure, wherein said first guidance element and said second guidance element are attached to said mounting structure.

3. The crimping tool according to claim 2, wherein at least one of said first guidance element and said second guidance element is rotatably attached to said mounting structure.

4. The crimping tool according to claim 3, wherein said at least one of said first guidance element and said second guidance element rotatably attached to said mounting structure comprises a circular disc with a U-formed indentation along a circumference of said circular disc.

5. The crimping tool according to claim 3, wherein said at least one of said first guidance element and said second guidance element rotatably attached to said mounting structure comprises a bearing shaft and a roller bearing.

6. The crimping tool according to claim 1, wherein said powering unit comprises a hydraulic drive arranged to increase said first distance so that said diameter of said loop decreases.

7. The crimping tool according to claim 1, wherein said powering unit is configured to increase said first distance by moving said first attachment point and or said second attachment point away from said first guidance element and said second guidance element.

8. The crimping tool according to claim 7, wherein both said first guidance element and said second guidance element are rotatable and wherein both said first guidance element and said second guidance element comprises a circular disc with a U-formed indentation along a circumference of said circular disc.

9. The crimping tool according to claim 1, wherein said powering unit is configured to increase said first distance by moving said first guidance element and said second guidance element away from said first attachment point and said second attachment point.

10. The crimping tool according to claim 1, wherein said second distance is larger than one radius of said flexible cable and smaller than five radii of said flexible cable.

11. The crimping tool according to claim 1, wherein said flexible cable is braided by fibers of a high strength material.

12. The crimping tool according to claim 11, wherein the high strength material is DYNEEMA fiber.

13. The crimping tool according to claim 1, further comprising a control unit configured to measure work performed by said powering unit and/or continually measure said first distance to ensure that said diameter of said loop has decreased sufficiently for establishing a mechanical and electrical connection between said first cable element and said second cable element.

14. A method for creating a mechanical and electrical connection between two cable elements using a crimping tool according to claim 1, the method comprising:

forming a loop with a flexible cable by folding said flexible cable and attaching a first end part to a first attachment point of said crimping tool and a second end part to a second attachment part of said crimping tool;

inserting a first cable element into said loop;

inserting a second cable element into said loop;

activating a powering unit of said crimping tool configured decrease a diameter of said loop to allow said flexible cable to apply a pressure on said first cable element and said second cable element; and deactivating said powering unit when said first cable element and said second cable element have been deformed so that a mechanical and electrical connection has been established.

15. The method according to claim 14, wherein said first cable element is a crimping connector and said second cable element is inserted into said crimping connector prior to activating said powering unit.

16. The method according to claim 14 further comprising removing said crimping tool from said first cable element and said second cable element after deactivating said powering unit, wherein removing said crimping tool is done by detaching at least one end part of said flexible cable from said crimping tool.

* * * * *